United States Patent [19]

Marsh

[11] 4,355,213

[45] Oct. 19, 1982

[54] MICROPHONE ASSEMBLY

[75] Inventor: Richard E. Marsh, Chicago, Ill.

[73] Assignee: Marsh Products, Inc., Batavia, Ill.

[21] Appl. No.: 251,376

[22] Filed: Apr. 6, 1981

[51] Int. Cl.[3] ..... H04R 1/00

[52] U.S. Cl. ..... 179/146 R; 179/179; 179/147; 179/152; 181/208

[58] Field of Search ..... 179/147, 148 F, 179, 179/146 C, , 152; 181/208; 248/415

[56] References Cited

U.S. PATENT DOCUMENTS

| | | | |
|---|---|---|---|
| 2,010,566 | 8/1935 | Schuetz | 179/147 |
| 2,481,271 | 9/1949 | Willey | 179/148 R |
| 3,053,339 | 9/1962 | Kishi | 179/148 R |
| 3,153,123 | 10/1964 | Harman | 179/148 R |
| 3,562,446 | 2/1971 | Wolf | 179/152 |

*Primary Examiner*—A. D. Pellinen
*Assistant Examiner*—L. Schroeder
*Attorney, Agent, or Firm*—Leo J. Aubel

[57] ABSTRACT

A microphone mounting assembly including an elongated tubing, having a mounting flange including a channel for adjustable receiving said tubing, and sand sealingly received in said tubing for providing acoustic-dampening characteristics.

6 Claims, 1 Drawing Figure

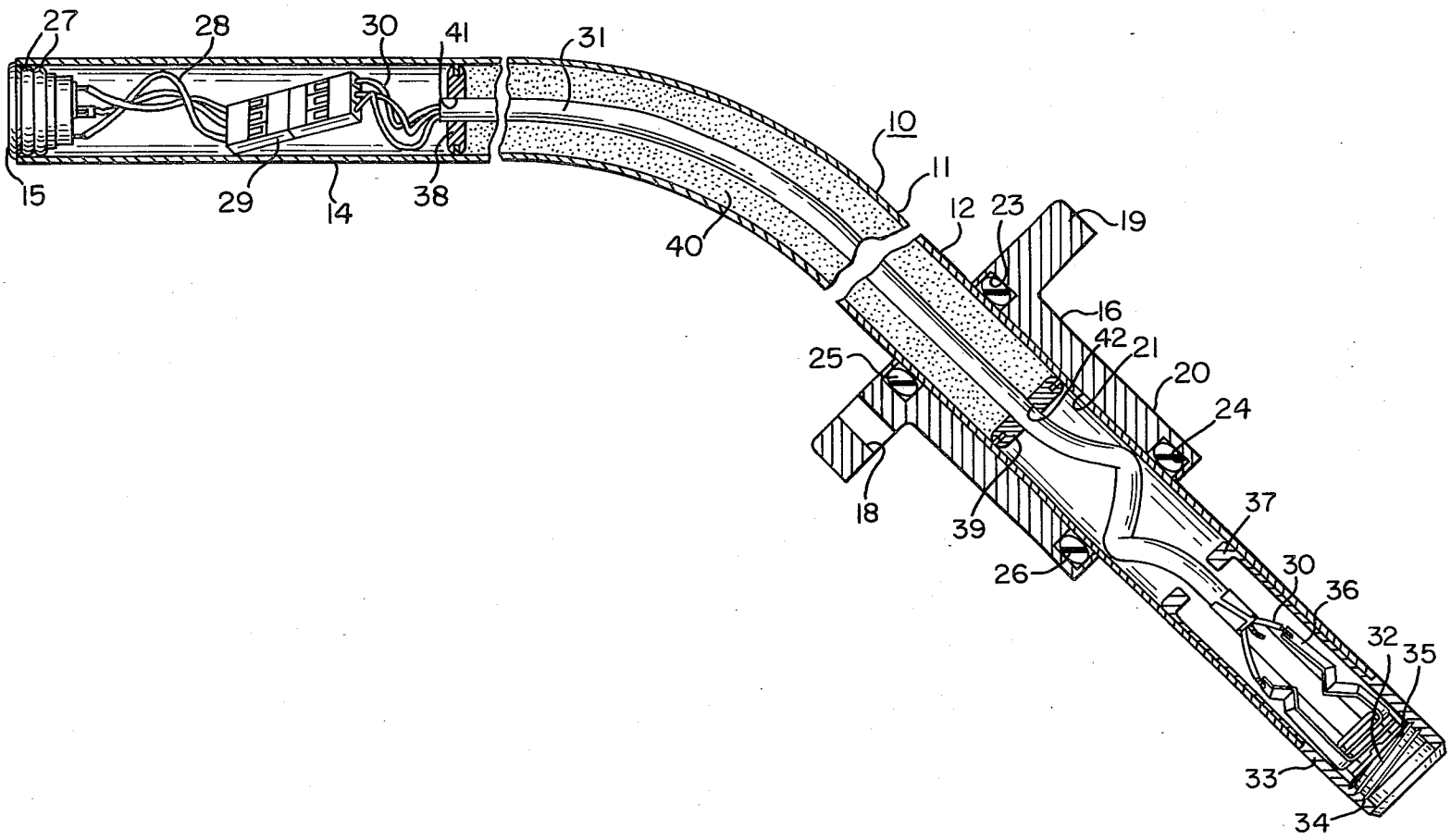
10
11
12
14
15
16
18
19
20
21
23
24
25
26
27
28
29
30
31
32
33
34
35
36
37
38
39
40
41
42

MICROPHONE ASSEMBLY

TECHNICAL FIELD

The present invention relates to microphones mounted on extension members, which are adjustable to permit convenient positioning of the microphone adjacent the sound source, such as the mouth of the person speaking into the microphone.

BACKGROUND PRIOR ART

Microphones mounted on adjustable members are commonly used in conjunction with audio amplifiers for use in sound systems, inter-communications systems, and in paging systems. Microphones of this type, sometimes termed "gooseneck microphones", include a microphone module mounted at one end of a tubular rod, which in turn mounted on a base flange. The tubular rod, and hence the microphone, may be adjusted to the desired position by extending the rod from the base flange and locking the rod in position, such as by a locking nut.

SUMMARY OF THE INVENTION

The present invention provides an improvement over the prior art microphone assemblies by providing a more durable and more sturdy assembly for a microphone. The invention further provides a more convenient and more easily adjustable rod assembly for a microphone, which assembly eliminates a locking nut but which still provides a firm, tight and stable positioning of the elongated rod or gooseneck carrying the microphone. The invention also provides a microphone assembly which provides excellent noise and vibration-dampening characteristics.

The foregoing features and advantages of the present invention will be apparent from the following more particular description of the invention. The accompanying drawing, listed hereinbelow, is useful in explaining the invention wherein:

The sole FIGURE herein is a view, partially in cross-section, of the inventive microphone assembly, showing the configuration of the microphone assembly, as well as depicting the internal components of the microphone assembly and the external mounting flange.

DETAILED DESCRIPTION

As shown in the FIGURE, the inventive microphone assembly 10 comprises a tube or tubing 11, such as of polished stainless steel, which is 0.75 inches in diameter, and 30 inches in length. It should, of course, be understood that the specific dimensions recited herein are not to be considered limited in any way. Tube or tubing 11 includes a straight or mounting portion 12 and a microphone-supporting portion 14, which receives a microphone cartridge or module 15 therein. The microphone cartridge 15 may be of any suitable manufacture; and, in one application, it is an electret microphone manufactured by PRIMO Manufacturing Co. Mounting portion 12 of tube 11 is mounted by a flange 16 of a suitable plastic or metal, such as DELRIN plastic or aluminum metal. The mounting flange 16 has a tubular body portion 20, with an axially-extending channel 21 which receives portion 12 of tube 11. Flange 16 includes a radially-enlarged circular shoulder 19, formed on one end of the tubular body portion 20. Flange 16 is, in turn, attached to a base (not shown), as by bolts or screws received in holes 18 formed in shoulder 19. Flange 16 includes recesses 23 and 24, formed adjacent the axially-opposed ends of flange 16. The recesses 23 and 24 have three closed sides and an open side, opening toward the axial channel 21 of flange 16, and may be formed in rectangular configuration. Flexible O-rings 25 and 26, which may be of a rubber-like or elastic material, are placed in the respective recesses 23 and 24.

The end of tube 11, that is, portion 12 of tube 11, is force-fitted into the channel 21 of flange 16, enabling the two eleastic O-rings 25 an 26 frictionally grip the tube 11 and hold the tube in position. As shown in the FIGURE, the O-rings 25 and 26 are compressed and deformed by the outer surface of tube 11 to thus provide a firm gripping action on the periphery of the tube 11. The tube 11 will remain in the position in which it is adjusted until manually or physically readjusted. The magnitude of the frictional grip of the tube 11 is determined by the amount of compression of the O-rings 25 and 26, which, in turn, is controlled by the depth of the recesses 23 and 24. Thus, the magnitude of the frictional grip of the tube 11 is determined by the manufacturer of the microphone assembly, rather than by the user.

The microphone cartridge 15, which is, as mentioned, of any suitable known design and is of cylindrical configuration, is fitted into the open end of the tube 11. Two O-rings, generally labeled 27, are positioned around the microphone cartridge 15 to engage the interior surface of the tubing and hold the cartridge 15 in position. The microphone cartridge 15 is electrically connected by three conductor wires, generally labeled 28, to a suitable terminal connector 29. Three conducting leads, generally labeled 30, extend from terminal connector 29 to and through a shielded cable 31, which cable extends substantially along the axis of the tube 11. The other end of the cable 31 terminates adjacent the opposite end of the tube 11. The leads 30, extending from cable 31, are connected to a phone jack 32, also of any suitable known design. Phone jack 32 is mounted in a tubular plastic insert 33, which in turn is bonded in the end of tube 11 or otherwise fixedly held therein. The interior surface of one end of insert 33 is threaded, as at 34, to receive the threads 35 of phone jack 32. The other, or interior, end of insert 32 includes inwardly-extending flanges 37 to position the jack end of cable 31 axially therein.

Importantly, the use of the phone jack 32 provides a rotary coupling to phone plug (not shown) so that the user can rotate the tube 11 without limit and without risk of twist damage to the cable (not shown) connected to the phone plug (not shown). By this means, a common cause of microphone failure is precluded.

A pair of tightly-fitting rubber or plastic grommets 38 and 39 are mounted in spaced relation within tube 11. Each of the grommets 38 and 39 has a central opening 41 and 42 for permitting the cable 31 to pass therethrough. Grommet 38 is positioned adjacent the connector 29, approximately three inches from the microphone 15 end of the tube 11. Grommet 39 is positioned in the tube 11, approximately four inches from the opposite, or phone jack 32, end of the tube 11.

Importantly, the spacing formed in tube 11 between the grommets 38 and 39 is filled with sand 40. As will be readily understood, the grommets 38 and 39 seal the sand 40 in the spacing between the grommets in tube 11. The foregoing feature provides excellent noise-dampening, and also makes the unit extremely rugged. Also, external vibrations are deadened or dampened by the assembly. This has a very positive effect in providing a much quieter and noise-free microphone.

While the invention has been particularly shown and described with reference to a apreferred embodiment thereof, it will be understood by those skilled in the art that various changes in form and details may be made therein without departing from the spirit and scope of the invention.

I claim:

1. A microphone mounting assembly for mounting a microphone module therein, said assembly comprising an elongated tubing, a mounting member having a channel therein for receiving said tubing, flexible means, means for retaining said flexible means in said mounting member and in position adjacent said channel, said flexible means compressingly engaging the surface of said tubing to thereby hold said tubing in a selected position.

2. A microphone assembly as in claim 1, further including means for forming a defined space in said microphone tubing, and sand filling said space, thereby providing acoustic dampening characteristics for said microphone assembly.

3. A microphone mounting assembly as in claim 1, wherein said means for retaining said flexible means comprise spaced recesses formed in said mounting member and said flexible means comprise rubber O-ring positioned in said recesses.

4. A microphone mounting assembly as in claim 1, wherein said spaced recesses comprise a pair of recesses, respectively formed adjacent axially opposite ends of said mounting member.

5. A microphone assembly as in claim 1, further including means for mounting the microphone module on one end of the tubing, and connector means for making an electrical connection at the other end of the tubing, and means for connecting said microphone module to said connector means.

6. A microphone assembly as in claim 1, wherein said mounting member includes radially-extending flanges whereby said mounting member may be mounted on a suitable base.

* * * * *